US005356136A

United States Patent [19]

Ippolito

[11] Patent Number: 5,356,136

[45] Date of Patent: Oct. 18, 1994

[54] AUTOGRAPH COMBINATION, REMOVABLY-ATTACHED BALL AND PEN

[75] Inventor: Nicholas W. Ippolito, 930 Osceola Dr., Boca Raton, Fla. 33432

[73] Assignee: Nicholas W. Ippolito, Commack, N.Y.

[21] Appl. No.: 51,339

[22] Filed: Apr. 23, 1993

[51] Int. Cl.[5] ..... A63B 43/00

[52] U.S. Cl. ..... 273/58 R; 273/58 C; 273/DIG. 30; D19/81

[58] Field of Search ..... 273/DIG. 30, 58 R, 58 C; 401/52, 88, 292; 15/435, 437; D19/77, 81–84, 100

[56] References Cited

U.S. PATENT DOCUMENTS

| | | | |
|---|---|---|---|
| D. 283,516 | 4/1986 | Huang | D19/84 |
| D. 292,991 | 12/1987 | Adler | D19/82 |
| D. 293,690 | 1/1988 | Adler | D19/82 |
| 1,438,114 | 12/1922 | Hume | 15/437 |
| 3,128,514 | 4/1964 | Parker et al. | 401/52 |
| 3,843,120 | 10/1974 | Ricci | 401/88 |

*Primary Examiner*—Vincent Millin
*Assistant Examiner*—Steven B. Wang

[57] ABSTRACT

A simplified autograph combination devise to be used by autograph seekers, combining a flexible pen with an autographable vehicle where the vehicle may be defined as mainly a baseball or it could be a football or basketball etc. where the pen forms the same contour as the vehicle to be autographed and is attached to the vehicle with a removably - attached felt fastener.

1 Claim, 1 Drawing Sheet

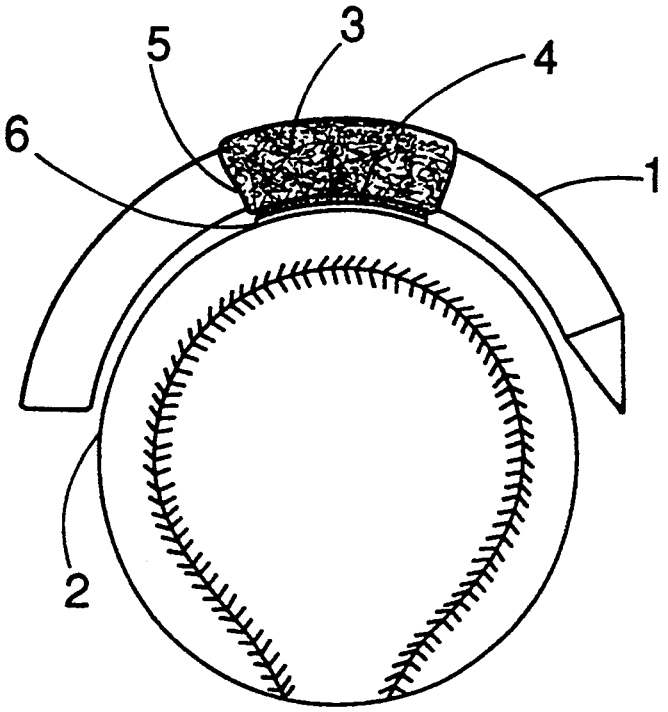
FIG. 1
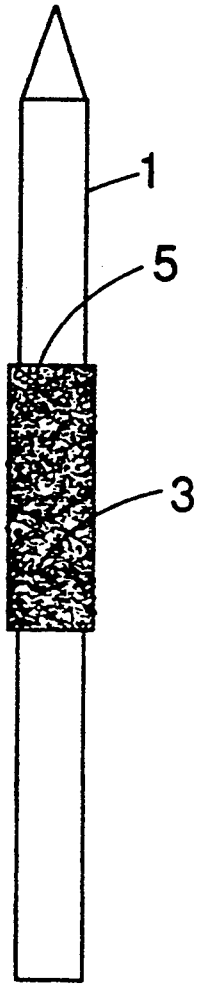
FIG. 2-A
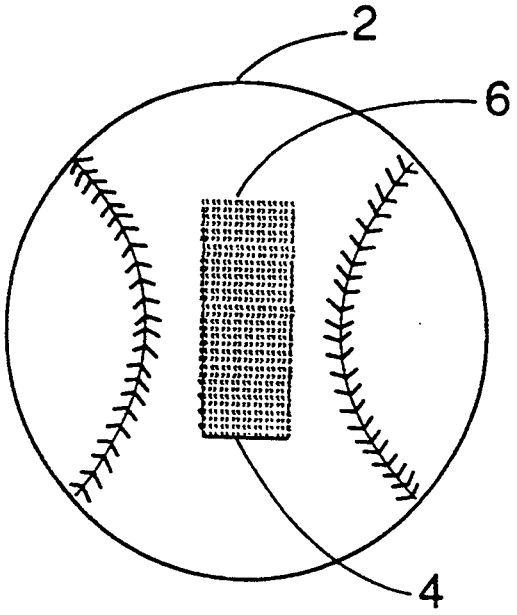
FIG. 2-B

AUTOGRAPH COMBINATION, REMOVABLY-ATTACHED BALL AND PEN

BACKGROUND OF INVENTION

This invention allows the autograph seeker a simpler and safer method to acquire the autograph of his choice on a baseball or other similar vehicle. No longer does it become necessary to pass or throw the ball and follow that by passing or throwing the pen, a practice that is seen many times at a baseball park and creating the danger of a pointed pen not finding its correct destination.

Now life for the autograph seeker is made simpler. He just throws or passes the ball to a receiver where said receiver gently removes pen from the ball, signs his or her autograph then places pen back on the ball and conveniently tosses combination ball and pen back to owner. This procedure makes it easier for the ball player or celebrity because he or she does not have to concentrate on two flying objects at once. The cycle time saved by this method allows signer to autograph more items. This was a simple idea waiting to happen.

The fact that the pen is now attached to the ball provides the autograph seeker with the capability to reach celebrities in areas that were unattainable using the old method.

Best of all the cost of this item on a production basis should not be much higher than the cost of a separate ball and pen.

SUMMARY OF INVENTION

This invention is the combination of four items especially designed and assembled to improve an existing function of celebrity autograph signing. The four items are ball, pen, felt fastener and cement.

The felt fastener consists of a male strip and a female strip that are attached separately with cement. One felt strip, male or female strip is cemented on the ball and the other opposite male or female felt strip is cemented on and/or around the pen. The pen designed and constructed in a flexible mode shall have the characteristics to maintain a contoured shape around the ball or to whatever vehicle it might be attached.

The ball can be a baseball as is mainly described in this document or it can be any other sport type ball.

Now ball and pen are firmly engaged, allowing ball and pen to be gently missiled through the air with the greatest of ease, safely and with the least amount of resistance.

BRIEF DESCRIPTION OF THE FIGURES

FIG. 1 is a side assembly view of the preferred embodiment of this invention, showing pen contoured around and attached to baseball.

FIG. 2 is a front view rotated 90° and shows the flexible pen in vertical, straight position, separated from mating vehicle which in this case is a baseball.

DESCRIPTION OF THE PREFERRED EMBODIMENT

FIG. 1 shows the attached combination of the pen 1 contoured in the same shape as the baseball 2. The baseball 2 is normally of standard size but doesn't necessarily have to be. Permanently attached around the pen 1 with cement 5 is a felt strip 3. This felt strip 3 can be the male or female member of the mating combination. The baseball 2 is equipped with its mating felt strip 4 and it is attached to the baseball with a cement 6 that preferably is of a nature that allows the felt to be removed at any desired time, usually after baseball has been completely signed.

FIG. 2 shows the pen 1 and the baseball 2 separated. The pen 1 with it's attached fastener type felt strip 3 member is shown in vertical position as opposed to a curved position that follows the contour of the baseball 2. It is desirable but not necessary for the flexible pen 1 that it gently spring to vertical position when in use and at the same time be easily bent back to the contour of the baseball 2 after signing. The baseball 2 is shown with mating fastener type felt strip 4, cemented in place with cement 6.

What is claimed is:

1. A combination removably-attached ball and pen assembly comprising a sport ball having a spherical contour, a flexible pen which is capable of following the contour of the sport ball when it is attached to the ball and is readily detachable from the sport ball to permit signing by a user of the sport ball and a means for removably attaching the ball and pen assembly comprised of two separate male and female strips, where one of the two separate strips is attached with cement glue to the ball and the other one of the two separate strips is wrapped around and permanently attached with cement glue to the pen.

* * * * *